United States Patent [19]

Felice

[11] 4,017,851

[45] Apr. 12, 1977

[54] POSITION-CONTROL MECHANISM FOR STEPWISE ROTATING MEMBERS

[75] Inventor: Fortunato Felice, Udine, Italy

[73] Assignee: Solari & C. Udine S.p.A., Udine, Italy

[22] Filed: Aug. 27, 1975

[21] Appl. No.: 608,325

[30] Foreign Application Priority Data

Sept. 4, 1974 Italy ..... 26931/74

[52] U.S. Cl. ..... 340/379; 340/373; 324/167; 335/272; 310/49 R; 235/103

[51] Int. Cl.[2] ..... G08B 5/00

[58] Field of Search ..... 340/373, 378, 379; 324/34 D, 167; 335/209, 272; 310/49 R; 235/103

[56] References Cited

UNITED STATES PATENTS

| | | | |
|---|---|---|---|
| 3,328,756 | 6/1967 | Prince et al. | 340/379 X |
| 3,518,665 | 6/1970 | Bristol | 340/373 |
| 3,710,686 | 1/1973 | Hanaas | 324/34 D X |
| 3,855,525 | 12/1974 | Bernin | 324/34 D |

*Primary Examiner*—John W. Caldwell
*Assistant Examiner*—William M. Wannisky
*Attorney, Agent, or Firm*—Haseltine, Lake & Waters

[57] ABSTRACT

The invention relates to a device for checking the angular position and the starting position of a roller supporting a plurality of indicating pallets, which roller is driven in stepwise rotation. The device comprises magnetic members adapted to sense the position of magnetic poles provided on the roller or on a member mechanically linked to the roller, whereby the number of steps taken by the roller, starting from a predetermined position, can be counted taking advantage of a circumferentially arranged Hall effect and without contact between the sensing members and the roller or the member mechanically linked thereto.

2 Claims, 7 Drawing Figures

POSITION-CONTROL MECHANISM FOR STEPWISE ROTATING MEMBERS

This invention relates in general to a device for controlling a preselected angular position of a member which is driven through a stepwise rotation.

More particularly, the invention relates to a device which is capable of checking the angular position and the zero or starting position of a roller bearing a plurality of indicator pallets and being an integral part of a remote display system.

As is well known to those skilled in the art, in remote display systems, where information is composed by means of a number of pallets placed side by side and each being a portion of a unit comprising a group of pallets as carried by a roller which is driven in stepwise rotation, the angular position of the pallet-carrying roller must be compared, from time to time, with a certain starting or zero position. The rollers are driven by step motors in which a permanently magnetized rotor exhibits a succession of N-S polarities and is set into motion in correspondence with two stator shoes which are alternatingly excited with different polarities.

The roller position sensing members, which thus sense the indications given by the pallets also, are formed in general by sliding electric contacts, as driven by the rotation of the roller as such, as described in greater detail in U.S. Pat. No. 3,482,240.

An object of the invention is to dispense with mechanically actuated contacts, and avoid the drawbacks which are of necessity inherent therein, such as wear, inaccuracy and poor reliability.

An aim of the invention is to permit the use of members which sense the position of the roller and are of the magnetic control type.

The presence of a polarity sequence on the rotor of the step motor conveniently permits the steps taken, starting from a preselected position, to be counted with a circumferentially arranged Hall effect sensing member.

As a matter of fact, at every step, the sensing member is positioned in confronting relationship with respect to either a North or South pole and emits corresponding signals. The adoption of a Hall effect sensing member, conversely, poses a more intricate problem. Actually, upon considering the limited number of degress between two consecutive positions on the roller, the presence of a shoe of a magnet which is rotated integrally with the roller originates a field which encompasses a wider angle than would be required for a uniequivocal display by the sensing member concerned. In point of fact, the sensing member can be influenced by the magnetic field prior to the roller's reaching the actual zero position.

Such an ambiguity of the signal is still retained even when one uses, while overcoming considerable technical difficulties, a permanent magnet having an extremely small cross-sectional area.

According to the present invention, the roller, the position of which is sensed, is connected to the arbor which carries a radially arranged permanent magnet, by the agency of a mechanical link which provides a discontinuous drive transfer, with such a ratio that the magnet-carrying arbor makes an entire rotation for each rotation of the roller, a Hall sensing member being arranged in correspondence with the magnet path.

The discontinuity of the drive transfer, which is thus such as to convert a continuous rotary motion into an intermittent rotary motion, effects a phased rotation of the magnet-carrying arbor and, during such phases, the rotary motion of the arbor is quicker than the motion of the roller, so that a narrower rotation of the roller giver rise to a wider rotation of the magnet, the sensitivity of the measurement of the Hall effect sensing member being thus enhanced.

In order that the structural and functional features of the control device according to the invention may be better understood, a possible embodiment thereof will be described hereinafter with reference to the accompanying drawings, wherein.

Figure 5:
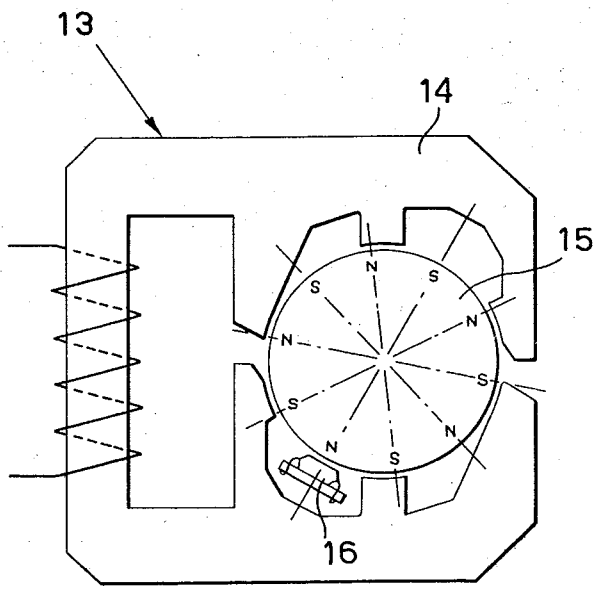
FIG. 5 is a diagram of a step motor incorporating a step-controlling sensing member.
Figure 1:
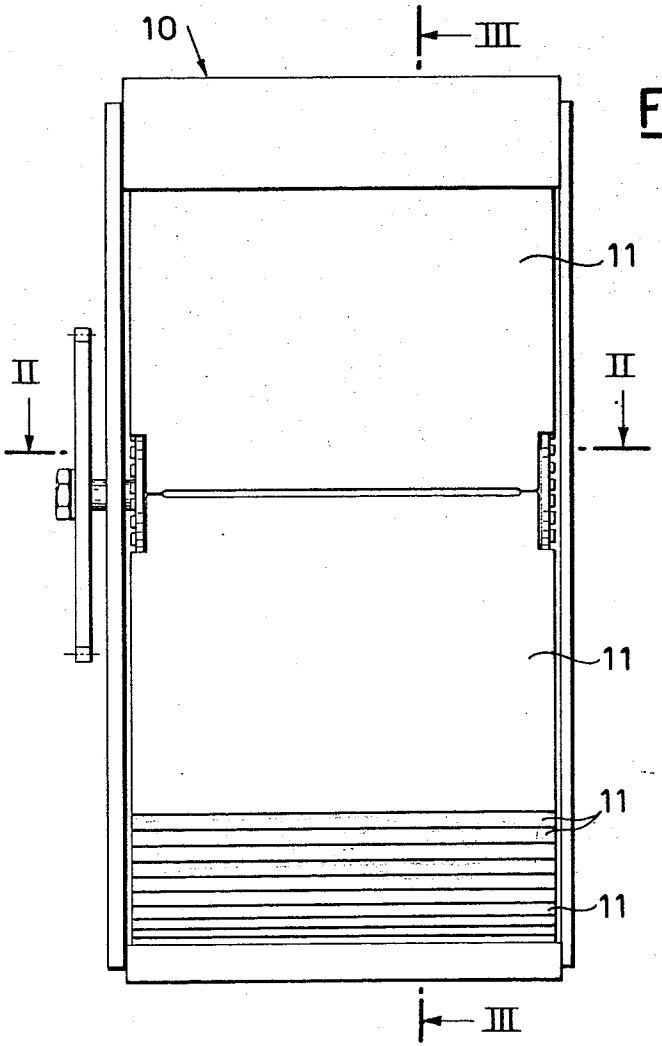
FIG. 1 is a front elevational view of a pallet unit embodying the invention.
Figure 2:
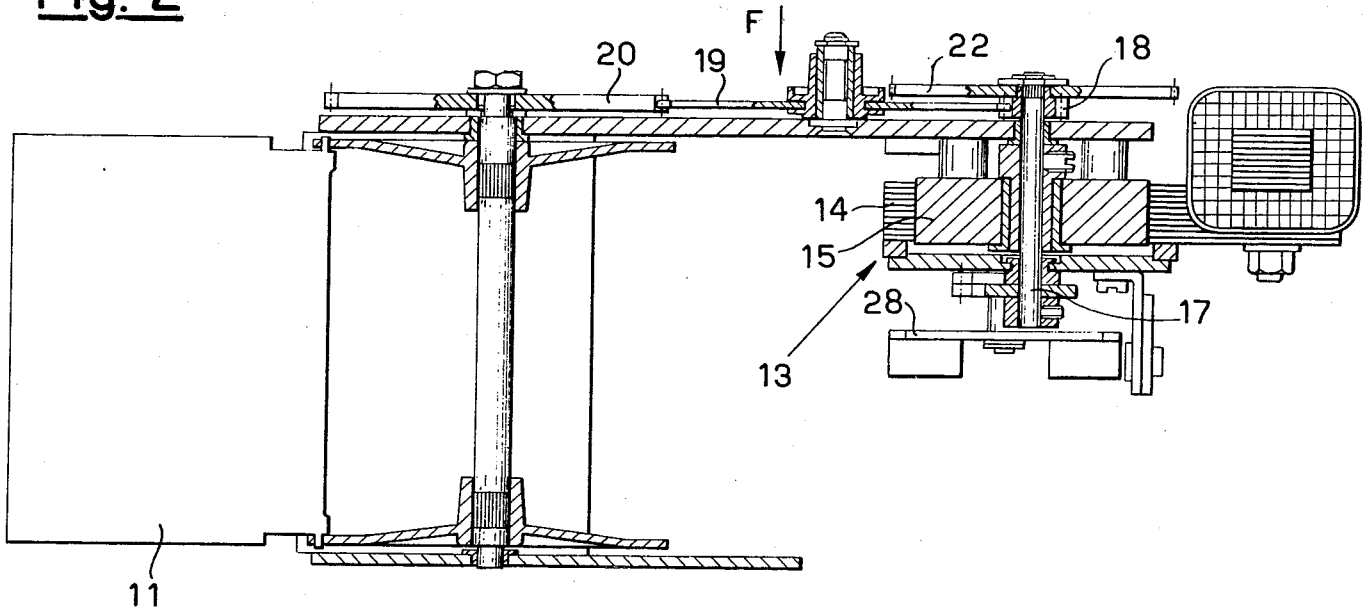
FIG. 2 is a plan view in cross-section, taken along the II—II of FIG. 1.

In the drawings, the reference numeral 10 indicates, in a general way, a unit which comprises, for example, 60 indicating pallets 11. The pallets 11 are conventionally pivoted to a roller 12, driven intermittently in rotation by a polarized motor 13, of the step-by-step type as diagrammatically shown in FIG. 5. The motor 13 comprises a stator 14 and a rotor 15 with five pole shoes "N", and five pole shoes "S". An electromagnetic sensing member 16 is affixed to the stator, in correspondence with the rotor periphery. As a result, at every step of the motor, a pole of opposite sign is brought into registry with the sensing member, the latter alternatingly delivering two different output signals. By comparing the number of pulses delivered to the motor with the number of the signals emitted by the sensing member, there is an accurate check that the number of steps taken by the motor equals that of the delivered pulses. The output shaft 17 of the motor is operatively connected to the pallet-carrying roller 12 through a mechanical link constituted by a pinion 18 and two gears 19, 20. A resilient pawl 21 engages the toothed rim of a wheel 22, the latter being integral with the shaft 17 so as to provide a undirectional stoppage for the shaft 17 itself.

Figure 3:
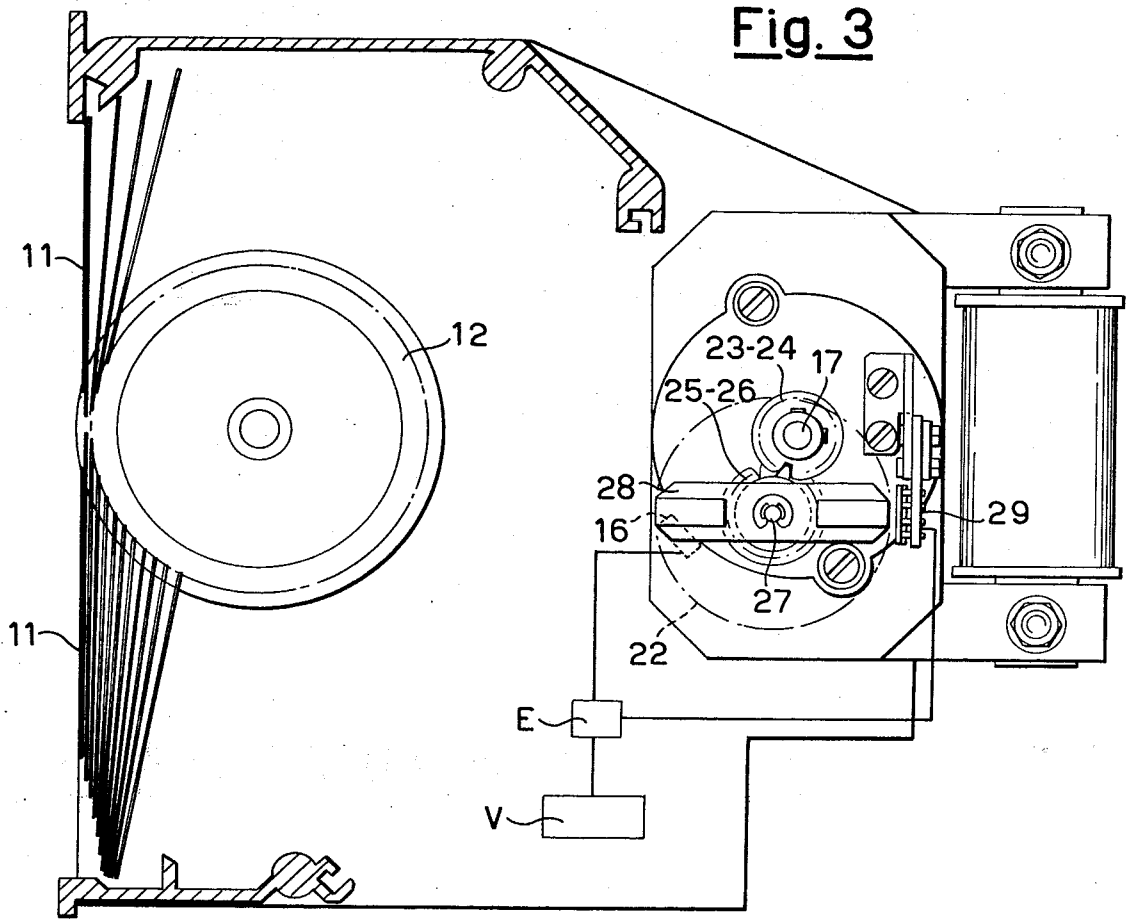
FIG. 3 is a cross-sectional view, taken along the III—III of FIG. 1.
Figure 4:
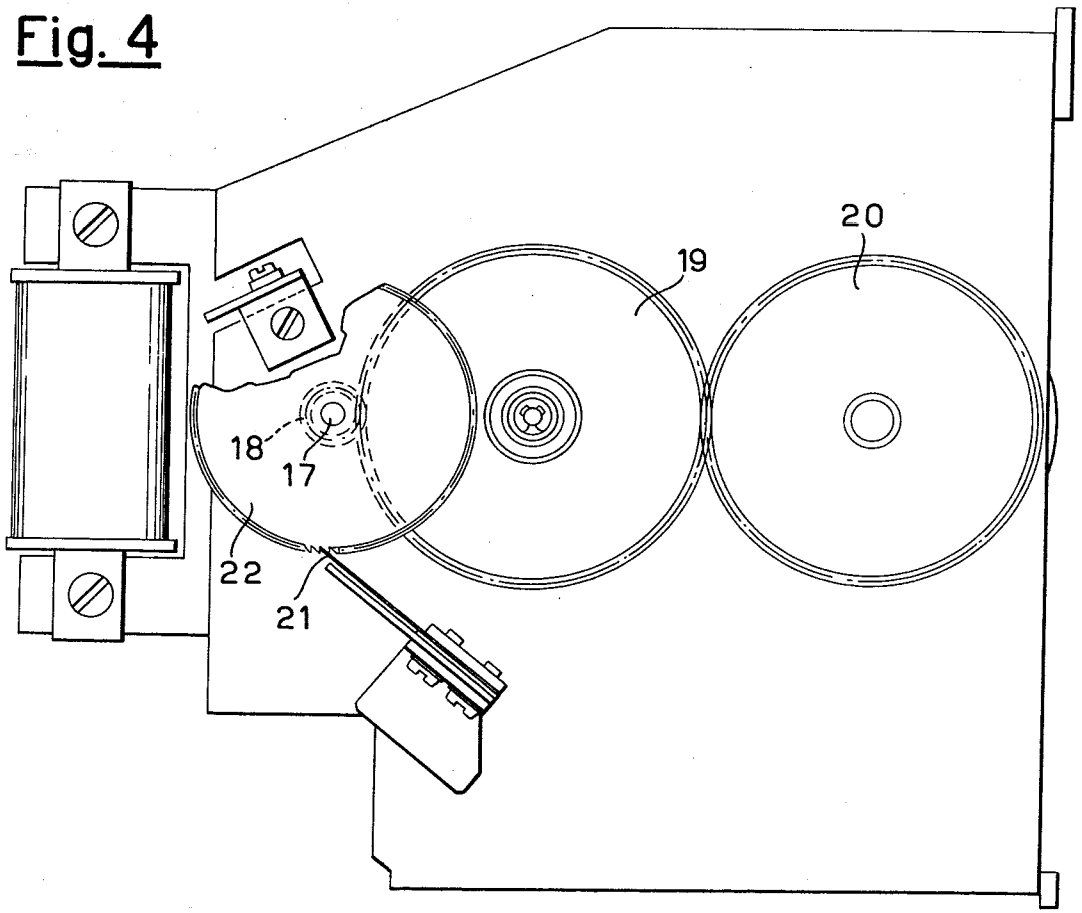
FIG. 4 is a side elevational view taken in the direction of the arrow F of FIG. 2.
Figure 6:
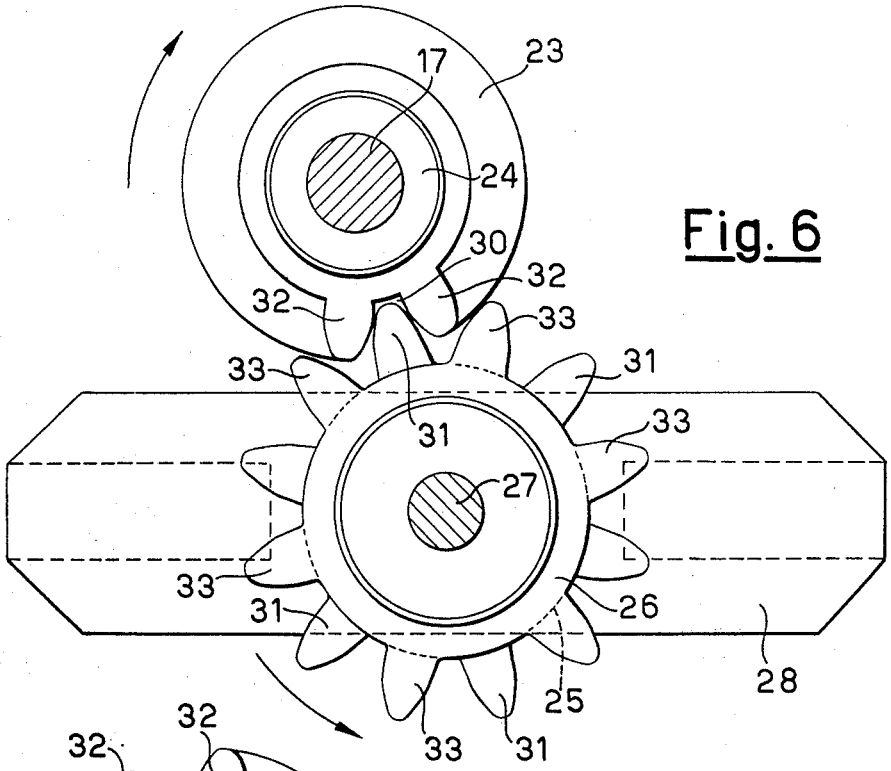
FIGS. 6 and 7 are views which show in detail the mechanism of actuation of the excitation magent for the electromagnetic sensing member which controls the zero position.
Figure 7:
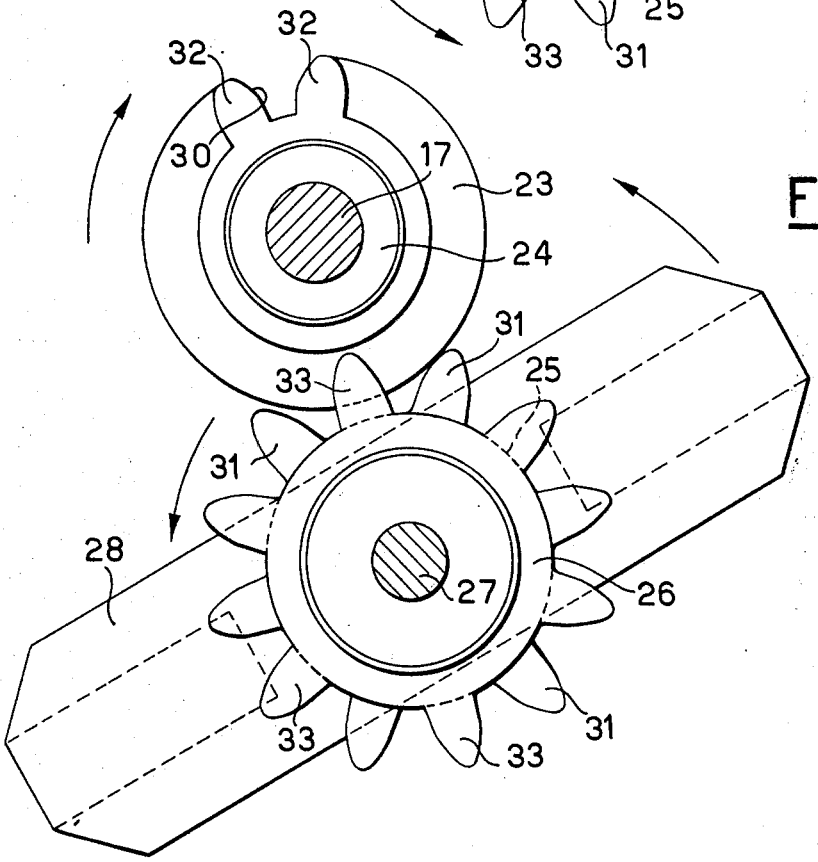

According to the invention, moreover, the shaft 17 carries at the end away from the pinion 18, a discontinuous drive transfer mechanism as composed by two cams 23, 24 cooperating with their respective cam followers in the form of gears 25, 26, these being keyed to the shaft 27 of an excitation magnet 28 cooperating with a Hall effect electromagnetic sensing member 29 (FIG. 3).

The cam 23 is the one with the larger diameter and is a circular disc with a peripheral notch 30 intended to mesh during each rotation of the driving shaft 17 with consecutive teeth of the six teeth 31 of the gear 25. The outline of the gears 25 and 26 is very much the same as that of a conventional crenellated wheel but from which a tooth has been removed every third consecutive tooth.

The diameter of the cam 23 is calculated so that the cam can be freely rotated between the teeth 31 until one of them engages the notch 30.

The cam 24 has a shorter diameter and has two teeth 32 which, at every rotation of the drive shaft 17 mesh with a consecutive tooth of the six teeth 33 of the gear 26, which are staggered by one half pitch with respect to the teeth 31 of the gear 25.

The operation of the control device as described hereinabove is, briefly resumed, as follows:

The linkage which connects the step-by-step motor to the excitation magnet 28 is constructed with such a ratio that the magnet comes into registry with th electromagnetic sensing member 29 only when the "zero" pallet is shown.

In view of this fact, since the gears 25, 26 have six teeth each, at every rotation of the drive shaft 17, the shaft 27 and thus the magnet 28, will go ahead through one-sixth of a rotation. However, during the movement, the gear ratio between the shafts 17 and 27 is one, since the pitch circles of the teeth 32 and 31 and 33 are equal. The peripheral speed of the magnet 28 in correspondence with the sensing member 29 is six times that which it would have, should it not be mounted on the shaft of the roller 12. This circumstance permits that, by means of the conventional processing of the signal emerging from the sensing member 29, the zero position may be detected with an adequate accuracy, the approximation being less than the pitch between the poles of the rotor 15 and thus than the pitch between the pallets of the roller 12.

The particular configuration of the intermittent drive transfer as composed by the gears 23, 24, 25, 26, is not a binding or vital element of the invention, either. As a matter of fact, since the intermittence is the only prerequisite, known and equivalent mechanisms can be adopted, such as the Maltese cross drive and the like.

In the example shown, the motor 13 drives the roller 15 through a reducing gear train, so that such a mechanical linkage afford a directly transferable drive for the leading member of the intermittence mechanism. However, such a motion could be transferred with an adequate overdrive of the motion of the roller shaft, should this be desired for any reason.

As has diagrammatically been shown in FIG. 3, the signals as delivered by the sensing members 16 and 29 are processed by a processor E and displayed through a display system V.

What is claimed is:

1. In a signalling apparatus including a signalling member, a step-by-step polarized motor having a rotor provided with a succession of poles of alternate polarity and a stator provided with two pole shoes alternately excited with different polarities, continuous drive transfer means connecting the signalling member to the motor rotor in such a manner as to cause the signalling member to be rotated stepwise at a speed which is a first integral submultiple of the rotating speed of the motor rotor, first sensing means for sensing the steps of rotation of the signalling member and second sensing means for sensing the passage of the signalling member through a predetermined angular position, the improvement comprising a rotating magnet having opposite poles, said first and second sensing means being constituted by respective first and second magneto-sensitive members, said first magneto-sensitive member being located in a fixed position near the rotor of the motor so as to sense successively the passage of the poles of the said rotor during rotation thereof and the second magneto-sensitive member being associated in a fixed position relative to said rotating magnet so as to sense the passage of one of the poles thereof at each rotation of said rotating magnet, discontinuous drive transfer means connecting said rotating magnet to the motor rotor in such a manner that each rotation of the motor rotor causes the rotating magnet to be rotated at the same speed thereof through a step of rotation which is a second integral sub-multiple of a complete rotation of the rotating magnet, said first and second submultiples being equal to one another so that the rotating magnet makes a complete rotation for each rotation of the signalling member.

2. A device according to claim 1 wherein the signalling member includes a roller and indication pallets linkably connected to said roller.

* * * * *